US010537139B2

(12) United States Patent
Mosley

(10) Patent No.: US 10,537,139 B2
(45) Date of Patent: Jan. 21, 2020

(54) DISPOSABLE ELECTRONIC NICOTINE DELIVERY DEVICE

(71) Applicant: Romo LLC, London, KY (US)

(72) Inventor: James C Mosley, London, KY (US)

( * ) Notice: Subject to any disclaimer, the term of this patent is extended or adjusted under 35 U.S.C. 154(b) by 181 days.

(21) Appl. No.: 15/822,163

(22) Filed: Nov. 26, 2017

(65) Prior Publication Data

US 2019/0159518 A1 May 30, 2019

(51) Int. Cl.
*A24F 13/00* (2006.01)
*A24F 47/00* (2006.01)
*H05B 3/44* (2006.01)

(52) U.S. Cl.
CPC ..... *A24F 47/008* (2013.01); *H05B 3/44* (2013.01)

(58) Field of Classification Search
CPC ..... A24F 47/00
USPC ..... 131/328–329
See application file for complete search history.

(56) References Cited

U.S. PATENT DOCUMENTS

2011/0226236 A1* 9/2011 Buchberger ..... A61M 11/041 128/200.23
2017/0258134 A1* 9/2017 Kane ..... A24F 47/008

* cited by examiner

*Primary Examiner* — Phuong K Dinh
(74) *Attorney, Agent, or Firm* — Kristin A. Grant; Grant Attorneys at Law PLLC

(57) ABSTRACT

An electronic nicotine delivery device, with a first end, a second end and a body, the body comprising of a transparent cylindrical outer casing, a battery, a heating element, and a liquid, the first end comprising of a mouthpiece and a first tamper seal, the mouthpiece having an opening for receiving vapor, the first tamper seal having a hole which is flush with the opening, the second end distal from the first end, wherein the second end comprises of a stop and a second tamper seal, the stop further comprising of one or more air holes, the second tamper seal not covering the one or more air holes.

17 Claims, 3 Drawing Sheets

DISPOSABLE ELECTRONIC NICOTINE DELIVERY DEVICE

BACKGROUND

Field of the Invention

The present invention relates generally to electronic nicotine delivery devices, and in particular, to an electronic nicotine delivery device comprising of a clear flexible casing and tamper sealed ends.

Related Art

For decades individuals have consumed nicotine via tobacco products. However, over the past few years electronic nicotine delivery devices, also commonly known as 'electronic cigarettes' or 'e-cigarettes,' have become increasingly popular. In correctional facilities, many inmates arrive with an addiction to nicotine. An abrupt disappearance of any substance of addiction can trigger behavioral issues. Providing inmates with access to nicotine helps to avoid such behavioral issues and eliminates the need for them to find ways to sneak nicotine products into correctional facilities.

E-cigarettes are typically made from rigid and opaque metals and hard plastics which may be easily weaponized and thus not safe to provide to an inmate. It is advantageous to provide a safe and secure means for inmates to consume nicotine, which does not require monitoring during use. The present invention provides such advantage.

The present invention discloses an e-cigarette which comprises of a transparent flexible tubing, encasing the e-cigarette's contents for providing internal visibility of the e-cigarette. Each end of the e-cigarette comprising of a tamper evident seal to indicate whether the e-cigarette has been disassembled at any point. The tamper evident seal of the first end of the e-cigarette containing a hole, said hole flush with the opening of the mouthpiece of the e-cigarette so that a user can use the e-cigarette without removing the tamper evident seal. The e-cigarette also comprising of a numeric, alphanumeric, or barcode labeling system for matching an e-cigarette to the inmate to whom it was provided.

SUMMARY OF THE INVENTION

It is to be understood that the phraseology and terminology employed herein are for the purpose of the description and should not be regarded as limiting.

The present invention is directed to an electronic nicotine delivery device comprising of a first end, a second end, and a body. The first end comprises of a mouthpiece and a first tamper seal, the mouthpiece comprises of an opening, wherein the opening is for receiving vapor from the electronic nicotine delivery device. The first tamper seal comprises of a hole where the hole is flush with the opening of the mouthpiece. The second end is distal from the first end, wherein the second end comprises of a stop and a second tamper seal, the stop further comprising of a one or more air holes, wherein the second tamper seal does not cover the one or more air holes. The body is in between the second end and the first end, and comprises of a cylindrical outer casing made of a transparent and flexible material, a battery inside of the cylindrical outer casing, a liquid inside of the cylindrical outer casing where the liquid is adjacent to the battery and closer to the first end than to the second end of the electronic nicotine delivery device, and a heating element connected to the battery, the heating element extending through the liquid. These and other features of the present invention will become readily apparent upon further review of the specification and drawings.

BRIEF DESCRIPTION OF THE DRAWINGS

Embodiments of the present invention will be described by way of example only, and not limitation, with reference to the accompanying drawings in which.

DETAILED DESCRIPTION

Figure 1:
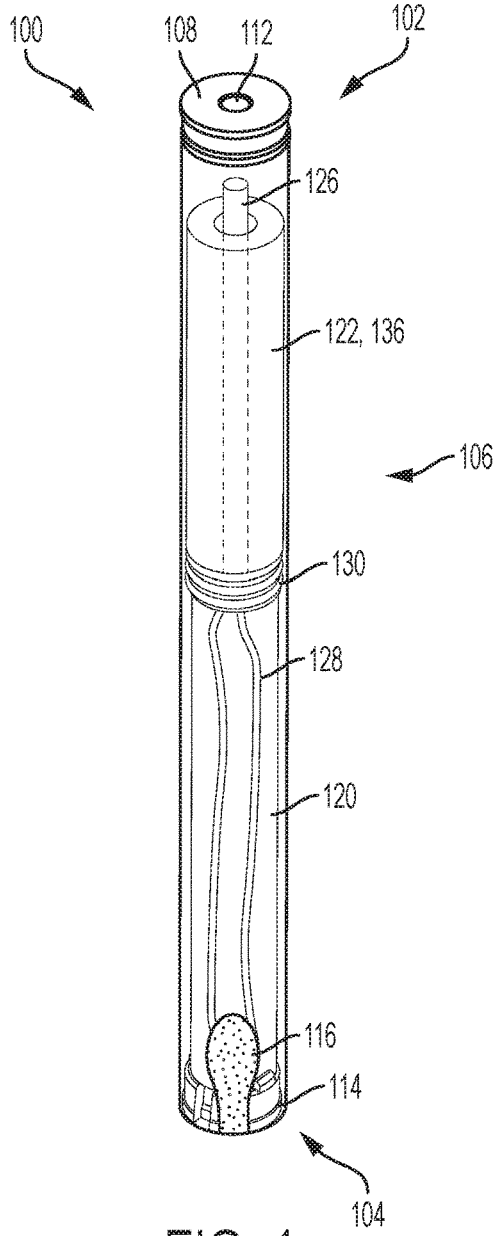
FIG. 1 is a perspective view of an electronic nicotine delivery device according to an embodiment of the present invention.
Figure 2:
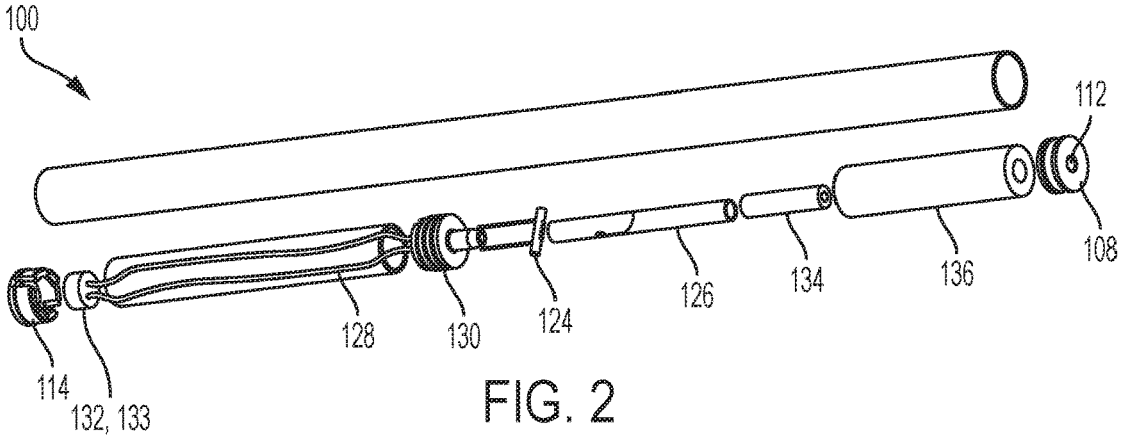
FIG. 2 is an exploded perspective view of an electronic nicotine delivery device according to an embodiment of the present invention.
Figure 3:
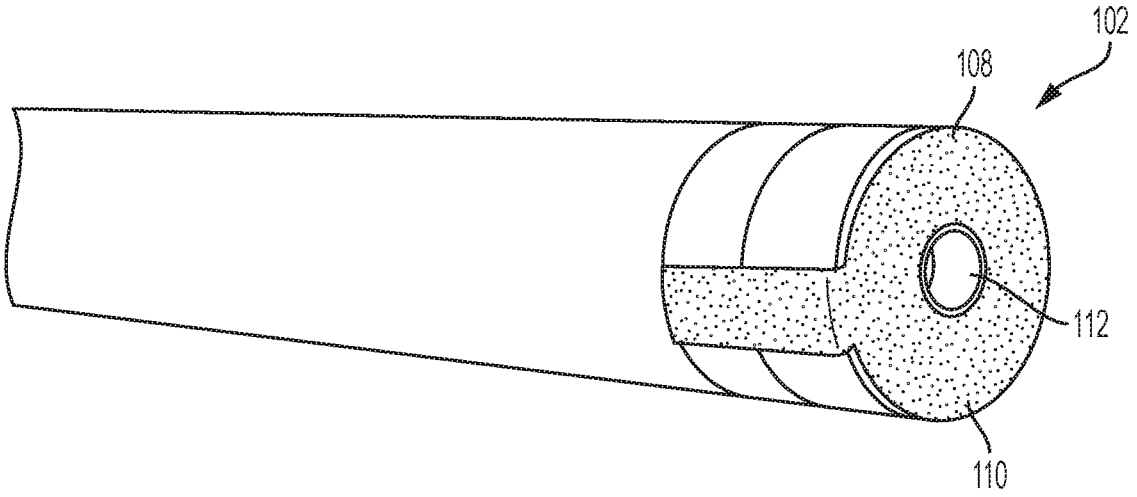
FIG. 3 is a magnified perspective view of a first end of an electronic nicotine delivery device according to an embodiment of the present invention.
Figure 4:
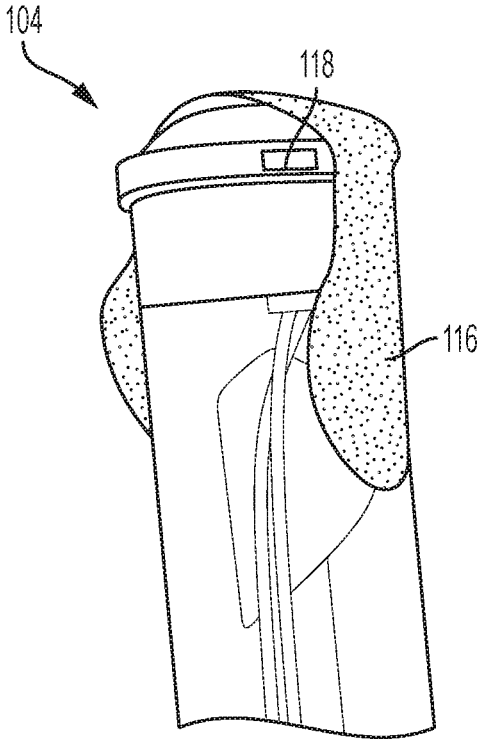
FIG. 4 is a magnified perspective view of a second end of an electronic nicotine delivery device according to an embodiment of the present invention.
Figure 5A:
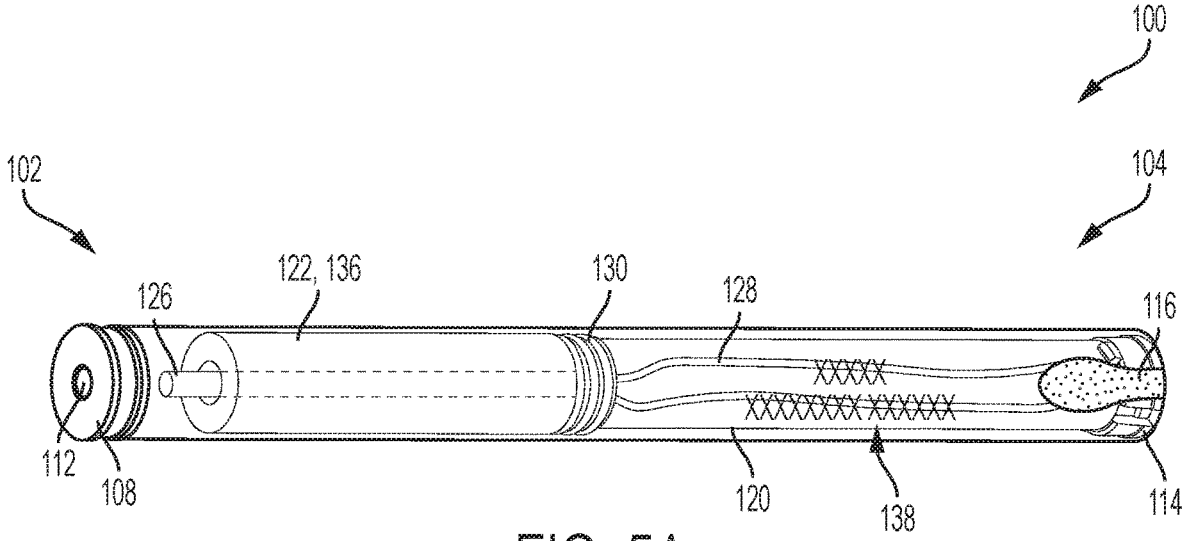
FIG. 5*a* is a perspective view of an electronic nicotine delivery device according to an embodiment of the present invention.
Figure 5B:
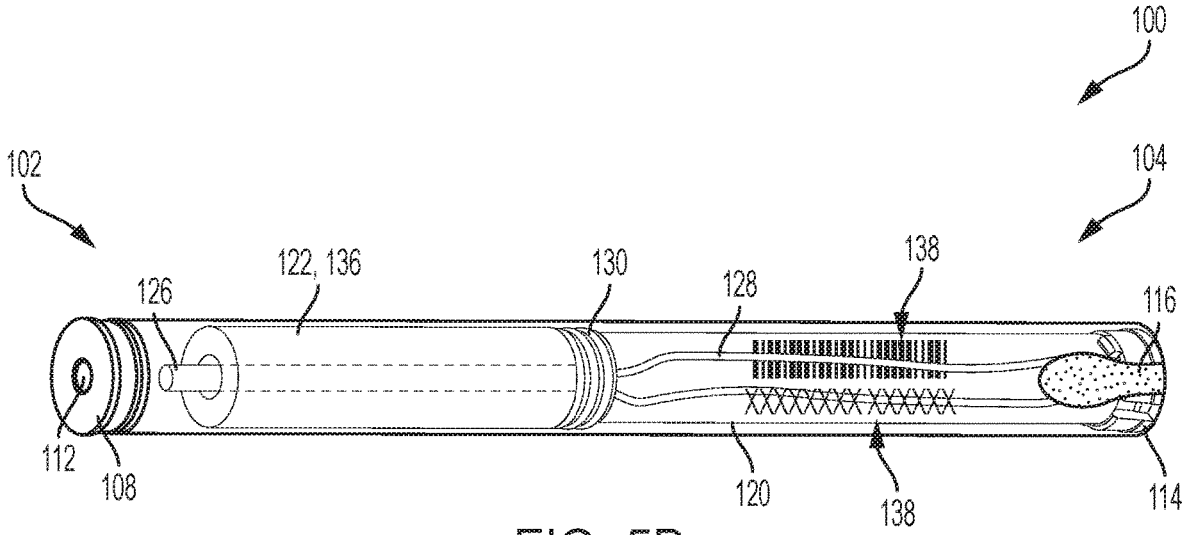
FIG. 5*b* is a perspective view of an electronic nicotine delivery device according to an embodiment of the present invention.

Referring now to the figures, where similar reference characters denote similar elements throughout the figures, FIGS. 1 to 4 show perspective views of an electronic nicotine delivery device 100 according to various embodiments of the present invention. The electronic nicotine delivery device comprising of a first end 102, a second end 104, and a body 106. The first end 102 comprises of a mouthpiece 108 and a first tamper seal 110, the mouthpiece 108 comprises of an opening 112, wherein the opening 112 is for receiving vapor from the electronic nicotine delivery device 100. The first tamper seal 110 comprises of a hole, where the hole is flush with the opening 112 of the mouthpiece 108 allowing use of the electronic nicotine device 100 without removal of the first tamper seal 110. The second end 104 is distal from the first end 102, wherein the second end 104 comprises of a stop 114 and a second tamper seal 116, the stop 114 further comprising of a one or more air holes 118, wherein the second tamper seal 116 does not cover the one or more air holes 118. The first and second tamper seals made from any tamper evident method, technology and/or material generally known in the art. The stop preferably made of plastic, however silicone may also be used. The body 106 is in between the second end 104 and the first end 102, and comprises of a cylindrical outer casing made of a transparent flexible material, a battery 120 inside of the cylindrical outer casing, a liquid 122 inside of the cylindrical outer casing where the liquid is adjacent to the battery 120 and distal to the second end 104 of the electronic nicotine delivery device 100, and a heating element connected to the battery 120, the heating element extending through the liquid 122. The cylindrical outer casing preferably made of a polycarbonate material, however similar transparent flexible materials may be used. In an embodiment of the present invention the battery 120 is a lithium-ion battery, however other types of batteries which are generally known in the art as suitable for these purposes may also be used. In a preferred embodiment of the present invention the liquid 122 comprises of 15 mg to 30 mg of nicotine, however embodiments of the present invention may be made with 0 mg of nicotine.

The heating element comprises of a heating coil 124, a high temperature wicking tube 126 and heating wires 128, wherein a portion of the heating wires 128 are inside of the high temperature wicking tube 126. The high temperature wicking tube preferably made of a woven rayon material. The heating wires extend through a silicone stop 130, located in between the battery 120 and the liquid 122, and connect to the battery 120. The silicone stop 130 providing a conduit for the heating wires 128. The heating wires 128 further extend down the side of the battery 120 to connect to a microprocessor 132 located at the second end 104 of the electronic nicotine delivery device 100. The microprocessor 132 further comprising of a lamp 133. The individual wires of the heating wires 128 not overlapping within the liquid 122 nor as they extend down the side of the battery 120. The lamp 133 preferably being a light emitting diode.

The heating element further comprises of a fiber rope wrapped around a portion of the high temperature wicking tube 126. In some embodiments of the present invention the heating element comprises of a nonwoven material 134 covered with a cotton polyfill 136 wrapped around the fiber rope and the high temperature wicking tube 126. In other embodiments of the present invention, the heating element comprises of the cotton polyfill 136 wrapped around the fiber rope and the high temperature wicking tube 126.

In a preferred embodiment, the cotton polyfill 136 is saturated with the liquid 122. A portion of the high temperature wicking tube 126 which is proximate to the first end 102 of the electronic nicotine delivery device 100 is not wrapped with the cotton polyfill 136, said portion of the high temperature wicking tube 126 being 1 mm to 2 mm in length.

Embodiments of the present invention comprise of a low dwell time. The dwell time is the length of time in seconds that a user may receive vapor per inhalation. The longer the dwell time, the increased amount of carcinogens inhaled. When a user inhales through the opening 112 of the mouthpiece 108, the heating coil 124 is ignited which then heats the unit thereby vaporizing the liquid 122. The lamp 133 illuminates upon inhalation, simulating a flame. The microprocessor 132 is pre-programmed to a specific dwell time. Once a user has inhaled for that pre-set length of time, the microprocessor 132 resets and the user is required to inhale again in order to receive additional vapor. In the present invention the preferred dwell time is 2 to 3 seconds.

In an embodiment of the present invention, the electronic nicotine delivery device 100 comprises of a numerical, alphanumerical or barcode labeling system 138 for allowing the tracking of each electronic nicotine delivery device 100 that is distributed.

What is claimed is:

1. An electronic nicotine delivery device, comprising:

a first end, comprising of a mouthpiece and a first tamper seal, said mouthpiece comprising of an opening, wherein said opening is for receiving vapor from the electronic nicotine delivery device and said first tamper seal comprises of a hole, said hole flush with said opening of the mouthpiece;

a second end distal from the first end, wherein said second end comprises of a stop and a second tamper seal, said stop further comprising of one or more air holes, wherein said second tamper seal does not cover said one or more air holes; and a body in between the second end and the first end, wherein said body comprises:

(a) a cylindrical outer casing, said cylindrical outer casing comprising of a transparent flexible material;

(b) a battery inside of the cylindrical outer casing;

(c) a liquid inside of the cylindrical outer casing, said liquid adjacent to said battery and said liquid distal to the second end of the electronic nicotine delivery device; and (d) a heating element connected to said battery, the heating element extending through the liquid.

2. The electronic nicotine delivery device of claim 1, wherein the heating element comprises of a heating coil, a high temperature wicking tube and heating wires, wherein and a portion of the heating wires are inside of the high temperature wicking tube.

3. The electronic nicotine delivery device of claim 2, wherein the body further comprises of a silicone stop in between the battery and the liquid, said silicone stop separating the battery and the liquid and providing a conduit for the heating wires.

4. The electronic nicotine delivery device of claim 3, further comprising of a fiber rope wrapped around a portion of the high temperature wicking tube, said fiber rope and said high temperature wicking tube further wrapped with a nonwoven material covered with a cotton polyfill.

5. The electronic nicotine delivery device of claim 3 further comprising of a fiber rope wrapped around a portion of the high temperature wicking tube, said fiber rope and said high temperature wicking tube further wrapped with a with a cotton polyfill.

6. The electronic nicotine delivery device of claim 4, wherein the cotton polyfill is saturated with the liquid.

7. The electronic nicotine delivery device of claim 5, wherein the cotton polyfill is saturated with the liquid.

8. The electronic nicotine delivery device of claim 6, wherein a portion of the high temperature wicking tube which is proximate to the first end of the electronic nicotine delivery device is not wrapped with the nonwoven material covered with the cotton polyfill, said portion of the high temperature wicking tube being 1 mm to 2 mm in length.

9. The electronic nicotine delivery device of claim 7, wherein a portion of the high temperature wicking tube which is proximate to the first end of the electronic nicotine delivery device is not wrapped with the cotton polyfill, said portion of the high temperature wicking tube being 1 mm to 2 mm in length.

10. The electronic nicotine delivery device of claim 7, wherein the second end further comprises of a microprocessor, said microprocessor connected to the heating wires.

11. The electronic nicotine delivery device of claim 9, wherein the second end further comprises of a microprocessor, said microprocessor connected to the heating wires.

12. The electronic nicotine delivery device of claim 10, wherein the microprocessor further comprises of a lamp.

13. The electronic nicotine delivery device of claim 11, wherein the microprocessor further comprises of a lamp.

14. The electronic nicotine delivery device of claim 1, further comprising of a numeric or alphanumeric label.

15. The electronic nicotine delivery device of claim 1, further comprising of a bar code.

16. The electronic nicotine delivery device of claim 12, further comprising of a dwell time of 2 seconds to 3 seconds.

17. The electronic nicotine delivery device of claim 13, further comprising of a dwell time of 2 seconds to 3 seconds.

* * * * *